US008284009B2

(12) United States Patent
Akiyama et al.

(10) Patent No.: US 8,284,009 B2
(45) Date of Patent: Oct. 9, 2012

(54) TRANSFORMER

(75) Inventors: Hideyuki Akiyama, Tokyo (JP); Tohru Hirohashi, Tokyo (JP); Kiyoshi Hironaka, Tokyo (JP)

(73) Assignee: FDK Corporation, Tokyo (JP)

( * ) Notice: Subject to any disclaimer, the term of this patent is extended or adjusted under 35 U.S.C. 154(b) by 142 days.

(21) Appl. No.: 12/744,140

(22) PCT Filed: Sep. 24, 2008

(86) PCT No.: PCT/JP2008/002628

§ 371 (c)(1),
(2), (4) Date: May 21, 2010

(87) PCT Pub. No.: WO2009/072227

PCT Pub. Date: Jun. 11, 2009

(65) Prior Publication Data

US 2010/0245009 A1 Sep. 30, 2010

(30) Foreign Application Priority Data

Dec. 6, 2007 (JP) ..... 2007-315799

(51) Int. Cl.
*H01F 27/30* (2006.01)
*H01F 27/24* (2006.01)

(52) U.S. Cl. ..... 336/198; 336/219

(58) Field of Classification Search ..... 336/175, 336/198, 208, 219
See application file for complete search history.

(56) References Cited

U.S. PATENT DOCUMENTS 3,750,073 A * 7/1973 Okano ..... 336/198
3,909,761 A * 9/1975 Miles ..... 336/192
4,000,483 A * 12/1976 Cook et al. ..... 336/98
4,027,279 A * 5/1977 Shigehara ..... 336/90
4,405,913 A * 9/1983 Finkbeiner ..... 336/98
4,683,518 A * 7/1987 Gwozdz ..... 361/263
4,716,394 A * 12/1987 Gordon ..... 336/192
4,988,968 A * 1/1991 Tochio et al. ..... 336/98
(Continued)

FOREIGN PATENT DOCUMENTS

EP 0 508 521 10/1992
(Continued)

OTHER PUBLICATIONS

International Search Report issued Dec. 22, 2008 in International (PCT) Application No. PCT/JP2008/002628.

*Primary Examiner* — Mohamad Musleh
*Assistant Examiner* — Joselito Baisa
(74) *Attorney, Agent, or Firm* — Wenderoth, Lind & Ponack, L.L.P.

(57) ABSTRACT

The present invention provides a transformer including a first bobbin around which a primary coil is wound, a second bobbin which is disposed adjacent to the first bobbin and around which a secondary coil is wound, a core disposed across the first and second bobbins and forming a closed magnetic path. The core is divided into a first core positioned on the side where the first bobbin is present and a second core positioned on the side where the second bobbin is present, and an insulating member is interposed in a magnetically coupled portion between the first core and the second core, the insulating member including outer circumference sheaths that cover at least one of the first and second cores and a barrier interposed between the opposing surfaces of the first and second cores.

5 Claims, 15 Drawing Sheets

U.S. PATENT DOCUMENTS

| | | | | |
|---|---|---|---|---|
| 5,745,021 | A * | 4/1998 | Miyoshi et al. | 336/196 |
| 6,734,777 | B2 * | 5/2004 | Yeh et al. | 336/208 |
| 7,142,079 | B2 * | 11/2006 | Chang | 336/90 |
| 7,193,497 | B2 * | 3/2007 | Yeh et al. | 336/198 |
| 7,528,694 | B2 * | 5/2009 | Tseng et al. | 336/212 |
| 7,696,702 | B2 * | 4/2010 | Iwai | 315/276 |
| 7,760,063 | B2 * | 7/2010 | Lin et al. | 336/208 |
| 2008/0024262 | A1 * | 1/2008 | Chang et al. | 336/208 |

FOREIGN PATENT DOCUMENTS

| | | |
|---|---|---|
| JP | 3-126030 | 12/1991 |
| JP | 5-129143 | 5/1993 |
| JP | 6-151203 | 5/1994 |
| JP | 2002-141229 | 5/2002 |
| JP | 2007-173359 | 7/2007 |
| JP | 2007-281190 | 10/2007 |

* cited by examiner

TRANSFORMER

TECHNICAL FIELD

The present invention relates to a high-voltage transformer that requires high insulating performance between the primary and secondary sides.

BACKGROUND ART

In general, safety standards require a variety of transformers to employ a structure in which a predetermined insulation distance (creepage distance) is ensured between a primary coil and a secondary coil.

On the other hand, an inverter transformer that causes a cold-cathode tube incorporated as a light source in a liquid crystal display to discharge and emit light boosts the voltage inputted to a primary coil to a high voltage ranging from 1000 to 2000 V in a secondary coil and outputs the high voltage to the cold-cathode tube.

An inverter transformer is therefore required to ensure insulation between the primary and secondary coils by providing a longer insulation distance therebetween than that provided in a typical low-voltage transformer. In a high-voltage isolation transformer in which a high voltage of several hundreds of volts is inputted to the primary coil, in particular, the insulation distance required between the primary and secondary coils is further longer.

In addition to the above, even if insulation is ensured between the primary and secondary coils in a high-voltage producing transformer of this type, a core that is disposed around the coils to form a closed magnetic path is not an insulator and, therefore, desired insulation performance is not obtained in the presence of the core.

On the other hand, for example, Patent Document 1 proposes a transformer including a bobbin having a through hole drilled through a central portion thereof and having primary and secondary coils wound around the outer circumference thereof and a pair of core members, parts of which are inserted into the through hole in the bobbin and abut each other inside and outside the through hole. In the transformer, an insulating member is provided between at least one of the pair of core members and the through hole of the bobbin.

According to the thus configured transformer, since the insulating member is provided between at least one of the pair of core members and the through hole of the bobbin, the creepage distance between the pair of core members and the primary and secondary coils can advantageously be extended.

In the transformer described in Patent Document 1, however, it is necessary to provide the insulating member not only between at least one of the core members and the through hole in the bobbin but also across the total length of the core member in order to achieve a desired advantageous effect, resulting in a problem of a complicated shape and structure of the insulating member, for example, when the core member is an E-shaped core.

Further, since the insulating member is provided between the core member and the through hole, the through hole in the bobbin needs to be larger than a conventional size, resulting in an increased size of the overall transformer, which is disadvantageously against a recent demand for size reduction.

As a result, there has been a strong demand in recent years to develop a high-voltage transformer whose overall size is not increased even when a high voltage is inputted to the primary coil and which can ensure insulation performance required between the primary and secondary sides.

Patent Document 1: Japanese Patent Laid-Open No. 2002-141229

SUMMARY OF THE INVENTION

The present invention has been made in view of the circumstances described above. An object of the present invention is to provide a transformer capable of improving insulation between the primary and secondary sides in a small, simple structure and reliably ensuring an insulation distance required when a higher voltage is employed.

First Aspect of the Invention

In the invention, a core forming a closed magnetic path is divided into a first core adjacent to a primary coil and a second core adjacent to a secondary coil. The first core and a first bobbin are considered as primary-side parts, and the second core and a second bobbin are considered as secondary-side parts. A desired insulation distance is ensured between the primary-side parts and the secondary-side parts by providing predetermined insulation in a magnetically coupled portion between the first and second cores.

That is, a first aspect of the present invention is a transformer including a first bobbin including a first winding portion around which a primary coil is wound, a second bobbin disposed adjacent to the first bobbin and including a second winding portion around which a secondary coil is wound, and a core made of a magnetic material, disposed across the first and second bobbins, and forming a closed magnetic path, wherein the core is divided into a first core positioned on the side where the first bobbin is present and a second core positioned on the side where the second bobbin is present, and an insulating member including an outer circumference sheath and a barrier is interposed in a magnetically coupled portion between the first and second cores, the outer circumference sheath covering the outer circumference of at least one of the first and second cores and the barrier being interposed between the opposing surfaces of the first and second cores.

In the transformer described above, for example, the first and second bobbins are disposed adjacent to each other in the axial direction thereof. Each of the first and second cores includes a pair of outer cores extending in the axial direction along the outer sides of the corresponding one of the first and second bobbins and an inner core positioned in between the outer cores and inserted into the corresponding one of the first and second winding portions. The insulating member is interposed between each of the first outer cores and the corresponding one of the second outer cores. A second barrier interposed between the opposing surfaces of the inner cores is formed between the first winding portion and the second winding portion.

In the transformer described above, for example, an insulating sheath is formed at an end of one of the first and second winding portions, the insulating sheath covering the outer circumference of the primary or secondary coil that is not associated with the one of the first and second winding portions. In this case, the insulating member may be formed integrally with the outer circumference of the insulating sheath.

In the transformer according to the first aspect of the present invention, since the core is divided into the first core positioned on the side where the first bobbin is present and forming the primary-side parts and the second core positioned on the side where the second bobbin is present and forming the secondary-side parts, and the insulating member providing electrical insulation is interposed in the magnetically coupled portion between the first and second cores, the insulation distance corresponding to the length of the outer circumference sheath of the insulating member can be ensured between the first and second cores.

As a result, the insulation between the primary coil and the secondary coil in the presence of the cores described above can be improved in a simple structure, whereby an insulation distance required between the primary coil and the secondary coil can be reliably ensured.

When each of the first and second cores includes outer cores and an inner core, provision of the second barrier, which is interposed between the opposing surfaces of the inner cores, between the first winding portion and the second winding portion, into which the respective inner cores are inserted, allows the insulation distance corresponding to the length of the outer circumference sheath of the insulating member described above to be ensured between the outer cores of the first and second cores. Further, the insulation distance corresponding to the axial length of the first or second winding portion can be ensured between the inner cores.

The thickness of the barrier of the insulating member and the thickness of the second barrier correspond to the gaps between the opposing surfaces of the first and second cores. The gaps are required to ensure not only electric insulation between the first and second cores but also predetermined magnetic connectivity. From this point of view, the thickness of each of the barriers, which form the gaps, is preferably set at a value ranging from 1.0 to 0.4 mm.

Further, when the insulating sheath is formed at an end of one of the first and second winding portions and covers the outer circumference of the primary or secondary coil that is not associated with the one of the first and second winding portions, the insulation distance corresponding to the length of the insulating sheath described above can be ensured between the coils even when the first and second bobbins are disposed adjacent to each other, whereby further size reduction is achieved.

Moreover, when the insulating member is integrated with the outer circumference of the insulating sheath, the insulating member can be formed by injection molding simultaneously with the first or second winding portion, whereby the transformer can be readily manufactured and the number of parts in the overall transformer can be reduced.

Second Aspect of the Invention

A second aspect of the present invention is an isolation transformer including a first bobbin around which a primary coil is wound, a second bobbin which is disposed adjacent to the first bobbin in the axial direction thereof and around which a secondary coil is wound, and a core made of a magnetic material, disposed across the first and second bobbins, and forming a closed magnetic path, wherein the core is divided in the axial direction into a first core positioned on the side where the first bobbin is present and a second core positioned on the side where the second bobbin is present, an insulating member is interposed between the axially opposing surfaces of the first and second bobbins and between the opposing surfaces of the first and second cores, and the outer circumferences of the primary and secondary coils and the outer circumferences of the first and second cores are surrounded seamlessly in the axial direction by a tubular, insulating outer circumference sheath member.

In the isolation transformer described above, for example, the insulating member is a barrier-shaped member integrally molded in the outer circumference sheath member.

In the isolation transformer described above, for example, each of the first and second cores is formed of an E-shaped core including a pair of outer cores extending in the axial direction along the outer sides of the corresponding one of the first and second bobbins and an inner core positioned in a place between the outer cores and inserted into the corresponding one of the first and second bobbins, and the outer circumference sheath member includes a partitioning wall interposed between the primary or secondary coil and each of the outer cores.

In the isolation transformer described above, for example, a plurality of annular protrusions are formed in the circumferential direction at certain intervals in the axial direction around the outer circumference of the outer circumference sheath member.

In the isolation transformer according to the second aspect of the present invention, the core is divided into the first core positioned on the side where the first bobbin is present and forming the primary-side parts and the second core positioned on the side where the second bobbin is present and forming the secondary-side parts, and the insulating member is interposed between the opposing surfaces of the primary-side parts and the secondary-side parts, the primary-side parts formed of the first bobbin and the first core and the secondary-side parts formed of the second bobbin and the second core. Further, the outer circumferences of the primary and secondary coils and the outer circumferences of the first and second cores are surrounded seamlessly in the axial direction by the tubular, insulating outer circumference sheath member. Therefore, the insulation distance corresponding to the axial length of the outer circumference sheath member can be ensured between the primary-side parts and the secondary-side parts.

As a result, the insulation between the primary side parts including the primary coil and the first core and the secondary side parts including the secondary coil and the second core can be improved in a simple structure without increase in overall size, whereby an insulation distance required between the primary coil and the secondary coil can be reliably ensured particularly when a high voltage is inputted to the primary coil.

The thickness of the insulating member in the axial direction corresponds to the gap between the opposing surfaces of the first and second cores. The gap is required to ensure not only electric insulation between the first and second cores but also predetermined magnetic connectivity.

Further, in the isolation transformer according to the second aspect of the present invention, molding the barrier-shaped insulating member integrally in the outer circumference sheath member allows the number of parts to be reduced and the structure to be further simplified. An assembling operation can also be simplified because it can be completed by inserting the primary-side parts formed of the first bobbin to which the first core is attached from one opening of the outer circumference sheath member and inserting the secondary-side parts formed of the second bobbin to which the second core is attached from the other opening of the outer circumference sheath member.

Further, when each of the first and second cores is an E-shaped core including outer cores and an inner core, forming the partitioning walls in the outer circumference sheath member between the primary coil and the respective outer cores of the first core and between the secondary coil and the respective outer cores of the second core allows the primary or secondary coil to be independently accommodated in the tubular space formed by the partitioning walls and the inner wall of the outer circumference sheath member.

As a result, the primary coil or the secondary coil can be protected from the other members that otherwise interfere therewith, whereby the overall structure and assembling operation can further be simplified because it is not necessary to wind a separate protective tape or any other suitable component around the outer circumference of the coil.

Further, when a plurality of annular protrusions are formed at certain intervals in the axial direction around the outer circumference of the outer circumference sheath member, the insulation distance between the primary-side parts and the secondary-side parts is the length along the protrusions and recesses in the axial direction, whereby the insulation distance can be longer than the axial straight length of the outer circumference sheath member (specifically, longer by the number of protrusions×the height of each of the protrusions×2). Therefore, the configuration described above allows further size reduction and is preferable when a high voltage is inputted to the primary coil.

DESCRIPTION OF SYMBOLS

Figure 1A:
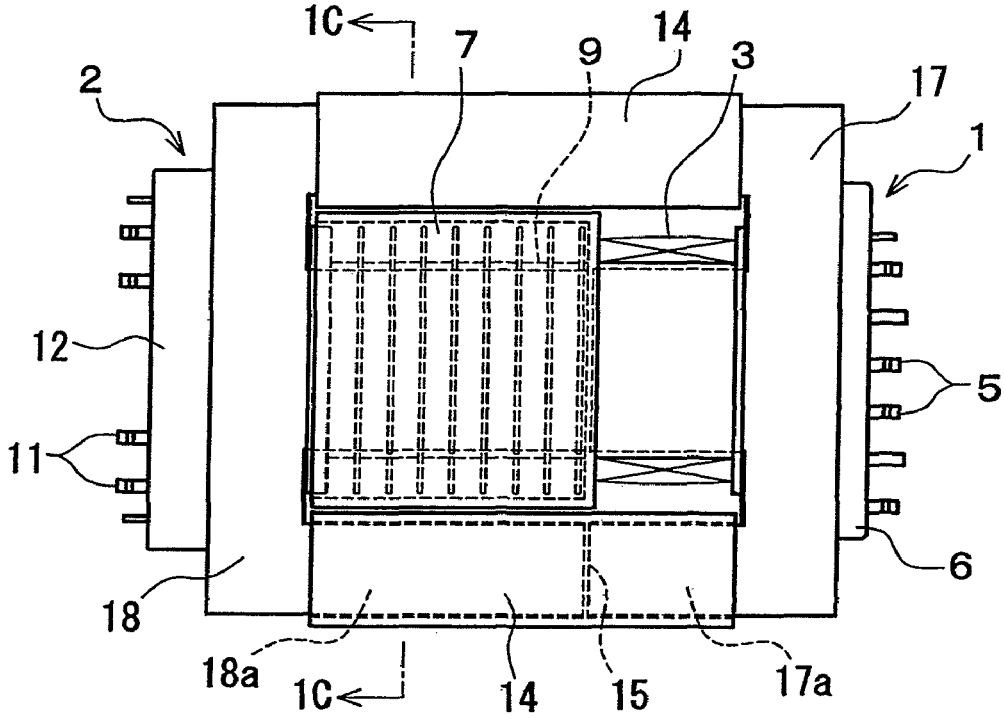
FIG. 1A is a plan view showing a first embodiment of a transformer according to the present invention.
Figure 1B:
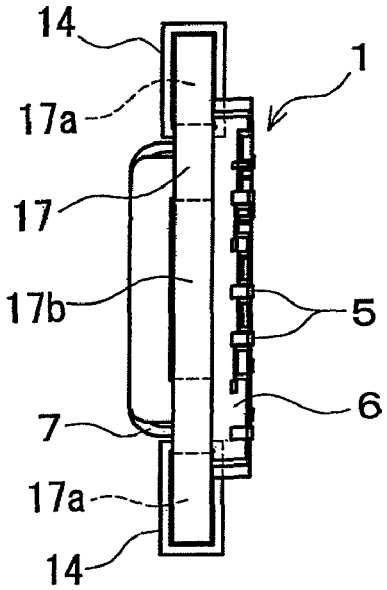
FIG. 1B is a right side view of the transformer shown in FIG. 1A.
Figure 1C:
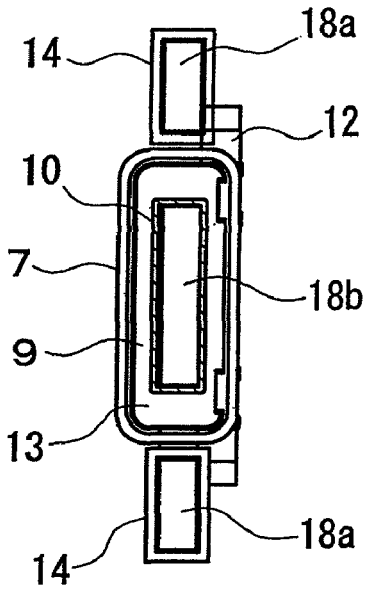
FIG. 1C is a cross-sectional view taken along the line 1C-1C shown in FIG. 1A.
Figure 2A:
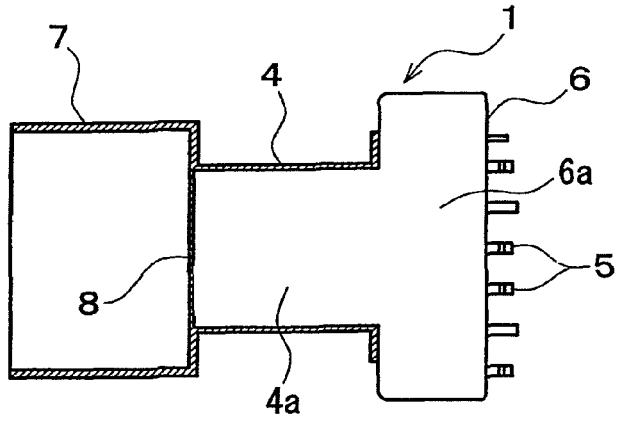
FIG. 2A shows a first bobbin, shown in FIG. 1A, before a primary coil is wound and is a cross-sectional view taken along the line 2A-2A shown in FIG. 2C.
Figure 2B:
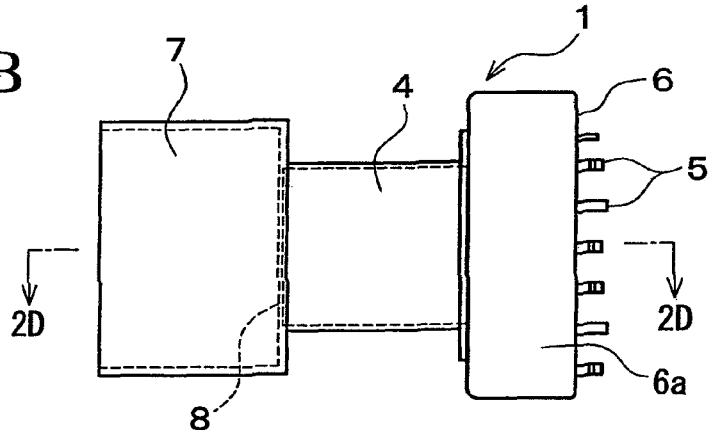
FIG. 2B is a plan view showing the first bobbin in FIG. 1A before the primary coil is wound.
Figure 2C:
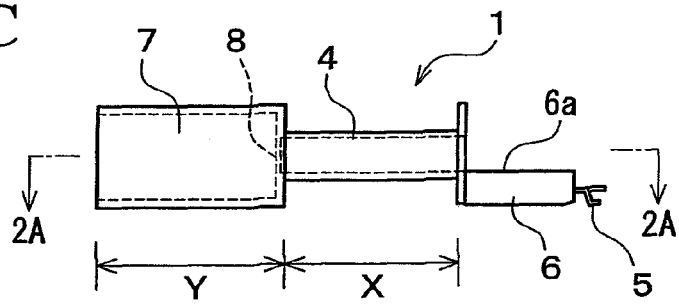
FIG. 2C is a front view showing the first bobbin in FIG. 1A before the primary coil is wound.
Figure 2D:
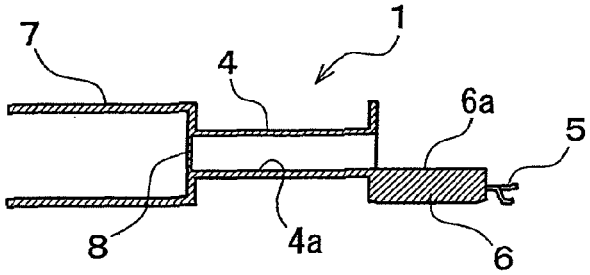
FIG. 2D is a cross-sectional view taken along the line 2D-2D shown in FIG. 2B.

1 first bobbin
2 second bobbin
3 primary coil
7 insulating sheath
8 barrier (second barrier)
9 secondary coil
10 second winding portion
14, 20, 23, 30 cover member (insulating member)
15, 21, 25, 31 barrier
16*a*, 22*a* first tubular section (outer circumference sheath)
16*b*, 22*b* second tubular section (outer circumference sheath)
17 first core
18 second core
17*a*, 18*a* outer core
17*b*, 18*b* inner core
24, 32 tubular section (outer circumference sheath)
101 first bobbin
102 second bobbin
103 primary coil
106 secondary coil
110 first core
111 second core
110*a*, 111*a* outer core
110*b*, 111*b* inner core
112 outer circumference sheath member
113 insulating wall (insulating member)
115 protrusion

DETAILED DESCRIPTION OF THE INVENTION

First Embodiment

FIGS. 1A to 7B show a first embodiment and a variation thereof in which a transformer according to the present invention is used as an inverter transformer for causing a cold-cathode tube that forms a backlight for an LCD to emit light. In the inverter transformer, a bobbin is divided into a first bobbin 1 and a second bobbin 2.

The first bobbin 1 includes a first winding portion 4 shaped into a rectangular tube which is formed in a central portion in the axial direction and around which a primary coil 3 (see FIGS. 1A and 5B) is wound, a first terminal placement portion 6 having a substantially rectangular plate-like shape which is formed at one end of the first winding portion 4 in the axial direction and which is studded with terminals 5 to which an end of the primary coil 3 is connected, and an insulating sheath 7 formed at the other end of the first winding portion 4 in the axial direction, the first winding portion 4, the first terminal placement portion 6, and the insulating sheath 7 made of an electrically insulating synthetic resin and integrally molded, as shown in FIGS. 2A to 2D.

The insulating sheath 7 is shaped into a rectangular tube whose width and thickness are slightly larger than those of the first winding portion 4, and a barrier (second barrier) 8 is molded between the insulating sheath 7 and the winding portion 4 and integrated therewith in such a way that the barrier 8 isolates the internal spaces in the insulating sheath 7 and the winding portion 4 from each other. The thickness of the barrier 8 in the axial direction is set at a value ranging from 1.0 to 0.4 mm.

The first winding portion 4 is formed in such a way that the internal space of the first winding portion 4 opens on the side where the first terminal placement portion 6 is present and an inner wall 4*a* of the first winding portion 4 is seamlessly connected to a surface 6*a* of the first terminal placement portion 6. The insulating sheath 7 has an axial length equal to or slightly larger than the axial length of a second winding portion 10, which will be described later, of the second bobbin 2.

Figure 3A:
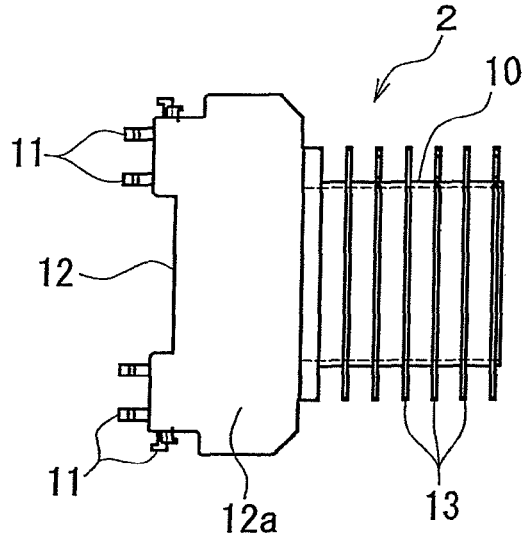
FIG. 3A is a plan view showing a second bobbin in FIG. 1A before a secondary coil is wound.
Figure 3B:
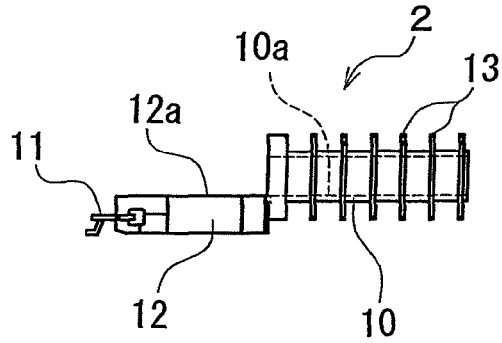
FIG. 3B is a front view showing the second bobbin in FIG. 1A before the secondary coil is wound.
Figure 3C:
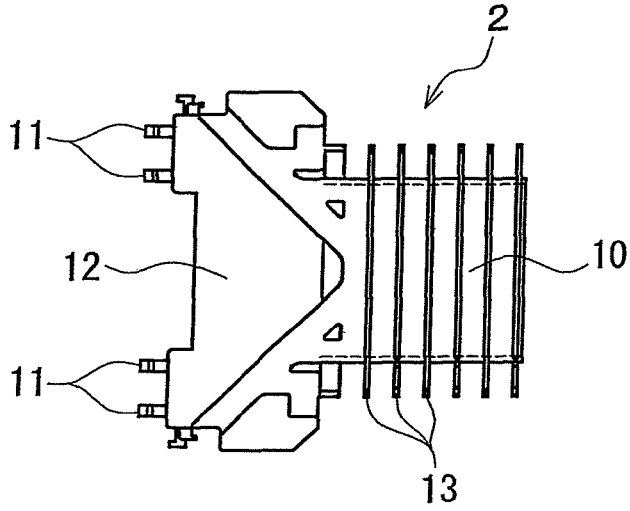
FIG. 3C is a bottom view showing the second bobbin in FIG. 1A before the secondary coil is wound.
Figure 4A:
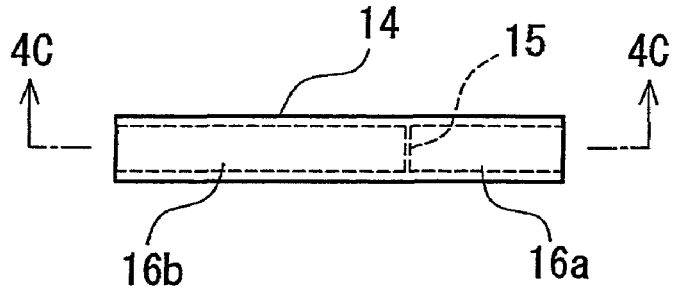
FIG. 4A is a front view showing each cover member in FIG. 1A.
Figure 4B:
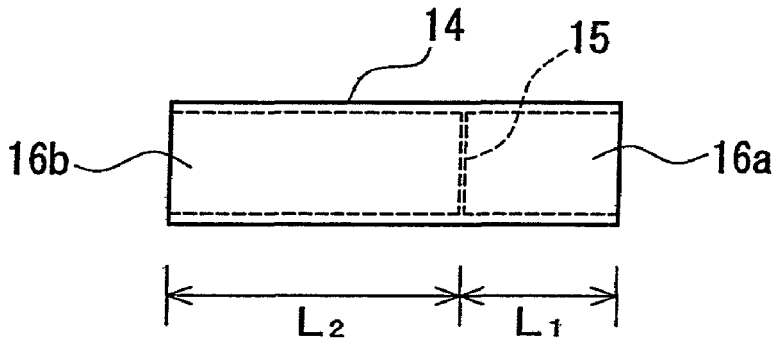
FIG. 4B is a plan view showing the cover member in FIG. 1A.
Figure 4C:
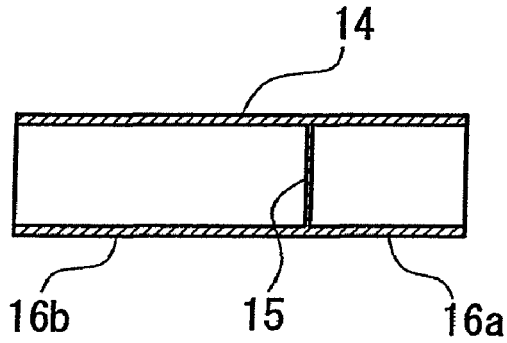
FIG. 4C is a cross-sectional view taken along the line 4C-4C shown in FIG. 4A.
Figure 4D:
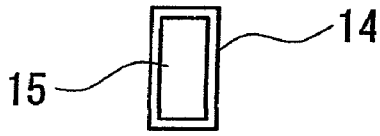
FIG. 4D is a side view showing the cover member in FIG. 1A.

On the other hand, the second bobbin 2 includes a second winding portion 10 shaped into a rectangular tube around which a secondary coil 9 (see FIGS. 1A and 5B) is wound and a second terminal placement portion 12 having a flat plate-like shape which is disposed at one end of the second winding portion 10 in the axial direction and which is studded with terminals 11 to which an end of the secondary coil 9 is connected, the second winding portion 10 and the second terminal placement portion 12 also made of an electrically insulating synthetic resin and integrally molded, as shown in FIGS. 3A to 3C.

The second winding portion 10 has a plurality of partitioning plates 13 formed at equal intervals in the axial direction around the outer circumference thereof and integrated therewith to prevent creeping discharge from occurring in the high-voltage secondary coil 9. The outer dimension of the partitioning plates 13 is slightly smaller than the inner dimension of the insulating sheath 7 in the first bobbin 1. Further, the second winding portion 10 is formed in such a way that the internal space of the second winding portion 10 opens on the side where the second terminal placement portion 12 is present and an inner wall 10*a* of the second winding portion 10 is seamlessly connected to a surface 12*a* of the second terminal placement portion 12.

Figure 5A:
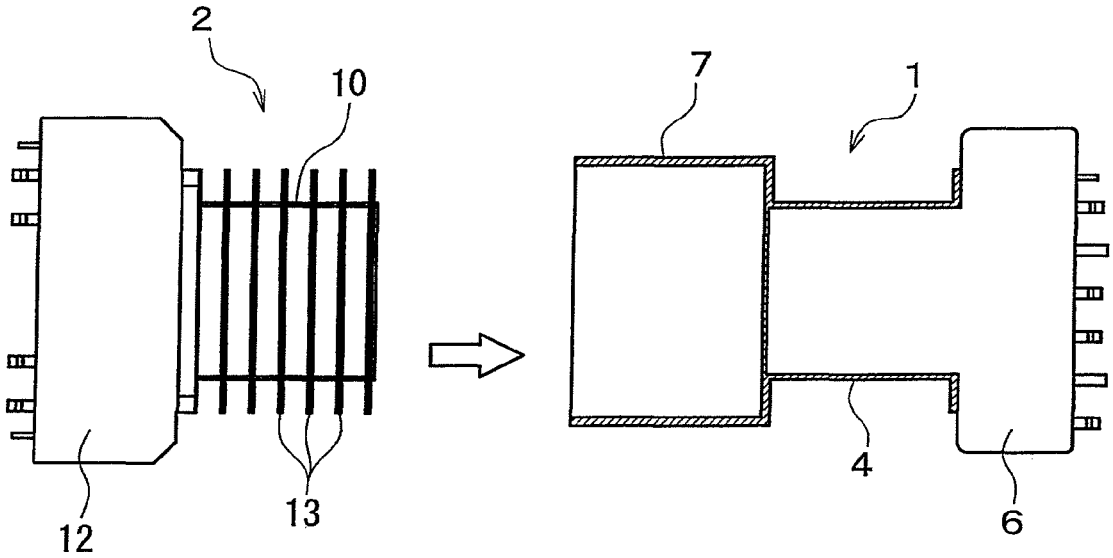
FIG. 5A is a plan view showing how the first and second bobbins are assembled.
Figure 5B:
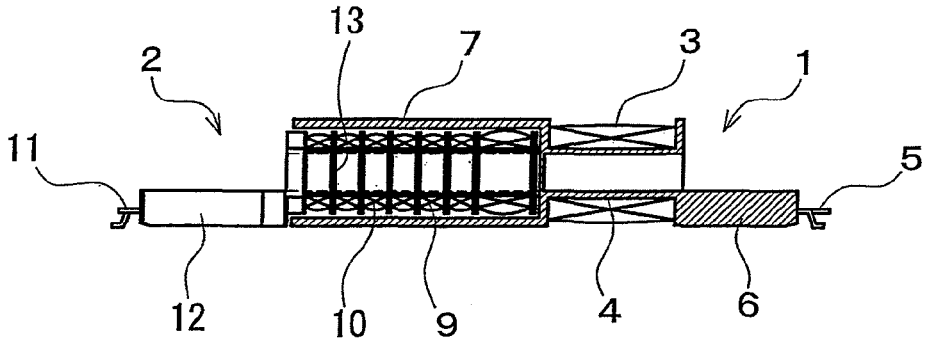
FIG. 5B is a longitudinal cross-sectional view of the assembled first and second bobbins.

The second bobbin 2 is integrally connected to the first bobbin 1 when the second winding portion 10, around which the secondary coil 9 is wound (the secondary coil 9 is omitted in FIG. 5A), is inserted into the insulation sheath 7 of the first bobbin 1, as shown in FIGS. 5A and 5B.

Figure 6:
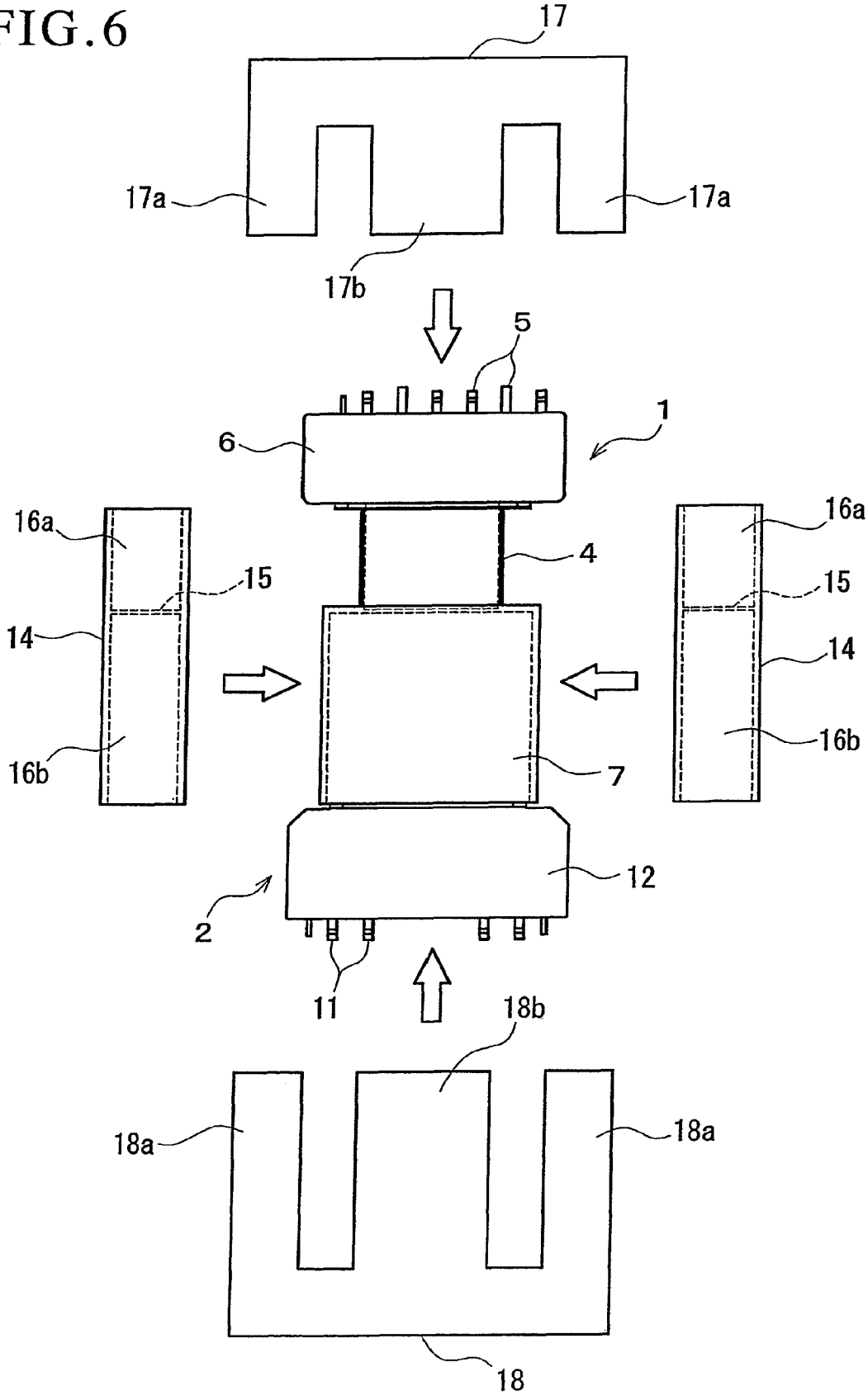
FIG. 6 is a plan view showing how first and second cores and the cover members are assembled.

A cover member (insulating member) 14 is disposed on both sides of the axial direction of the first and second bobbins 1, 2, as shown in FIG. 6. Each of the cover members 14 is made of an electrically insulating synthetic resin and shaped into a rectangular tube that opens at both ends, and a barrier 15 is formed in the cover member 14, as shown in FIGS. 4A to 4D. The thickness of the barrier 15 in the axial direction is set at a value ranging from 1.0 to 0.4 mm.

The barrier 15 is formed in a position where a first tubular section (outer circumference sheath) 16*a* formed in the area between the barrier 15 and one end of the cover member 14 has a length $L_1$ substantially equal to the axial length of the first winding portion 4 and a second tubular section (outer circumference sheath) 16*b* formed in the area between the barrier 15 and the other end of the cover member 14 has a length $L_2$ substantially equal to the axial length of the second winding portion (or the insulating sheath 7).

Cores formed of first and second cores 17, 18 and forming a closed magnetic path are disposed in the first and second bobbins 1, 2, as shown in FIGS. 1A to 1C and 6. The first and second cores 17, 18 are E-shaped cores including pairs of outer cores 17*a*, 18*a* extending in the axial direction along the outer sides of the respective first and second bobbins 1, 2 and inner cores 17*b*, 18*b* positioned in between the outer cores 17*a*, 18*a*.

Each of the outer cores 17*a* and the inner core 17*b* of the first core 17 has a length substantially equal to the axial length of the first winding portion 4, and each of the outer cores 18*a* and the inner core 18*b* of the second core 18 has a length substantially equal to the axial length of the second winding portion 10 (or the insulating sheath 7).

As shown in FIG. 6, the first core 17 is attached in such a way that the outer cores 17*a* are inserted into the first tubular sections 16*a* of the respective cover members 14 and the inner core 17*b* is inserted into the internal space in the first winding portion 4.

On the other hand, the second core 18 is attached in such a way that the outer cores 18*a* are inserted into the second tubular sections 16*b* of the respective cover members 14 and the inner core 18*b* is inserted into the internal space in the second winding portion 10.

In the thus configured transformer, the first core 17 and the second core 18 can be electrically insulated from each other because not only are the outer cores 17*a*, 18*a* of the first and second cores 17, 18 inserted into the first and second tubular sections 16*a*, 16*b* of the electrically insulating cover members 14 and the barriers 15 are provided between the opposing surfaces of the outer cores 17*a*, 18*a* but also the inner cores 17*b*, 18*b* are inserted into the respective first and second winding portions 4, 10 and the barrier 8 is provided between the opposing surfaces of the inner cores 17*b*, 18*b*.

Further, the insulation distance corresponding to the length ($L_1$+$L_2$) of the first and second tubular sections 16*a*, 16*b* of each of the cover members 14 shown in FIGS. 4*a* to 4D can be ensured between the outer cores 17*a* and 18*a*. Similarly, the insulation distance corresponding to the axial length (X+Y) of the first winding portion 4 and the insulating sheath 7 shown in FIG. 2C can be ensured between the inner cores 17*b* and 18*b*.

In addition to the above, since the insulating sheath 7, which covers the outer circumference of the secondary coil 9, is formed at the end of the first winding portion 4, the insulation distance corresponding to the length Y of the insulating sheath 7 can be ensured between the primary coil 3 and the secondary coil 9.

As described above, according to the transformer described above, since the core forming a closed magnetic path is formed of two divided cores, the first core 17 positioned on the side where the first bobbin 1 is present and forming a primary-side part and the second core 18 positioned on the side where the second bobbin 2 is present and forming a secondary-side part, and the first core 17 and the second core 18 are electrically insulated from each other with a sufficient insulation distance ensured, the insulation between the primary coil 3 and the secondary coil 9 in the presence of the cores can be improved in a simple structure. As a result, an insulation distance required between the primary coil 3 and the secondary coil 9 can be reliably ensured.

Moreover, since the thickness of the barrier 15 of each of the cover members 14 and the barrier 8 formed between the first winding portion 4 and the insulating sheath 7 is set at values ranging from 1.0 to 0.4 mm, electric insulation is achieved between the first core 17 and the second core 18, and predetermined magnetic connectivity can be ensured at the same time.

The first embodiment has been described with reference to the case where the length of the outer and inner cores 17*a*, 17*b* of the first core 17 is formed to be shorter than the length of the outer and inner cores 18*a*, 18*b* of the second core 18, and in correspondence with this, the barrier 15 of each of the cover members 14 is formed in a position where the length $L_1$ of the first tubular section 16*a* is shorter than the length $L_2$ of the second tubular section 16*b*, but the present invention is not limited thereto.

Figure 7A:
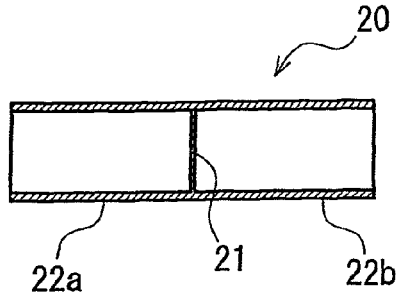
FIG. 7A is a cross-sectional view showing a variation of the cover member in FIG. 4A.

That is, a cover member (insulating member) 20 shown in FIG. 7A can alternatively used. The cover member 20 has a barrier 21 formed at the center in the longitudinal direction so that a first tubular section 22*a* and a second tubular section 22*b* have the same length.

Figure 7B:
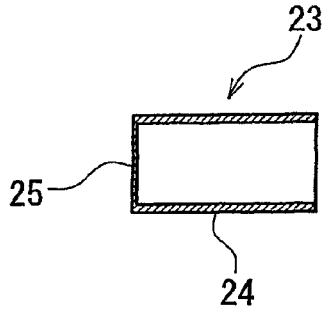
FIG. 7B is a cross-sectional view showing another variation of the cover member in FIG. 4A.

Further, when a necessary insulation distance is relatively short, a cover member (insulating member) 23 shown in FIG. 7B can alternatively used. The cover member 23 has a tubular section 24 into which only each of the outer cores of one of the cores is inserted and a barrier 25 is integrally formed at an end of the tubular section 24.

Second Embodiment

Figure 8:
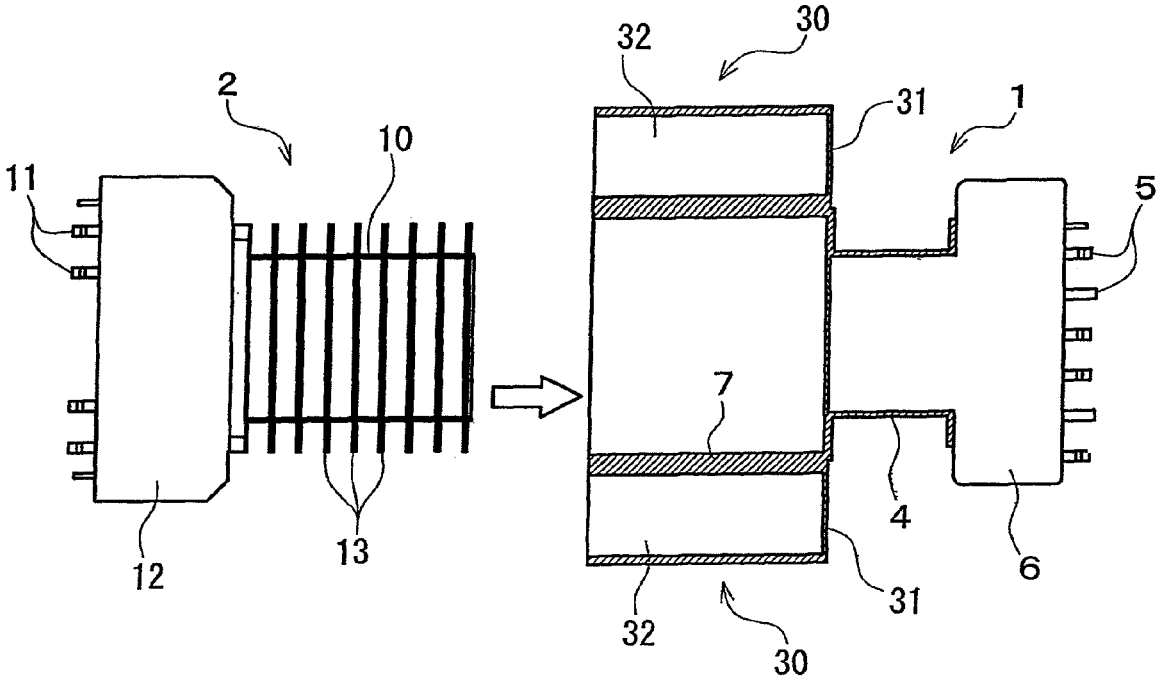
FIG. 8 shows how first and second bobbins are assembled in a second embodiment of the transformer according to the present invention and is a plan view with the first bobbin cross-sectioned.
Figure 9:
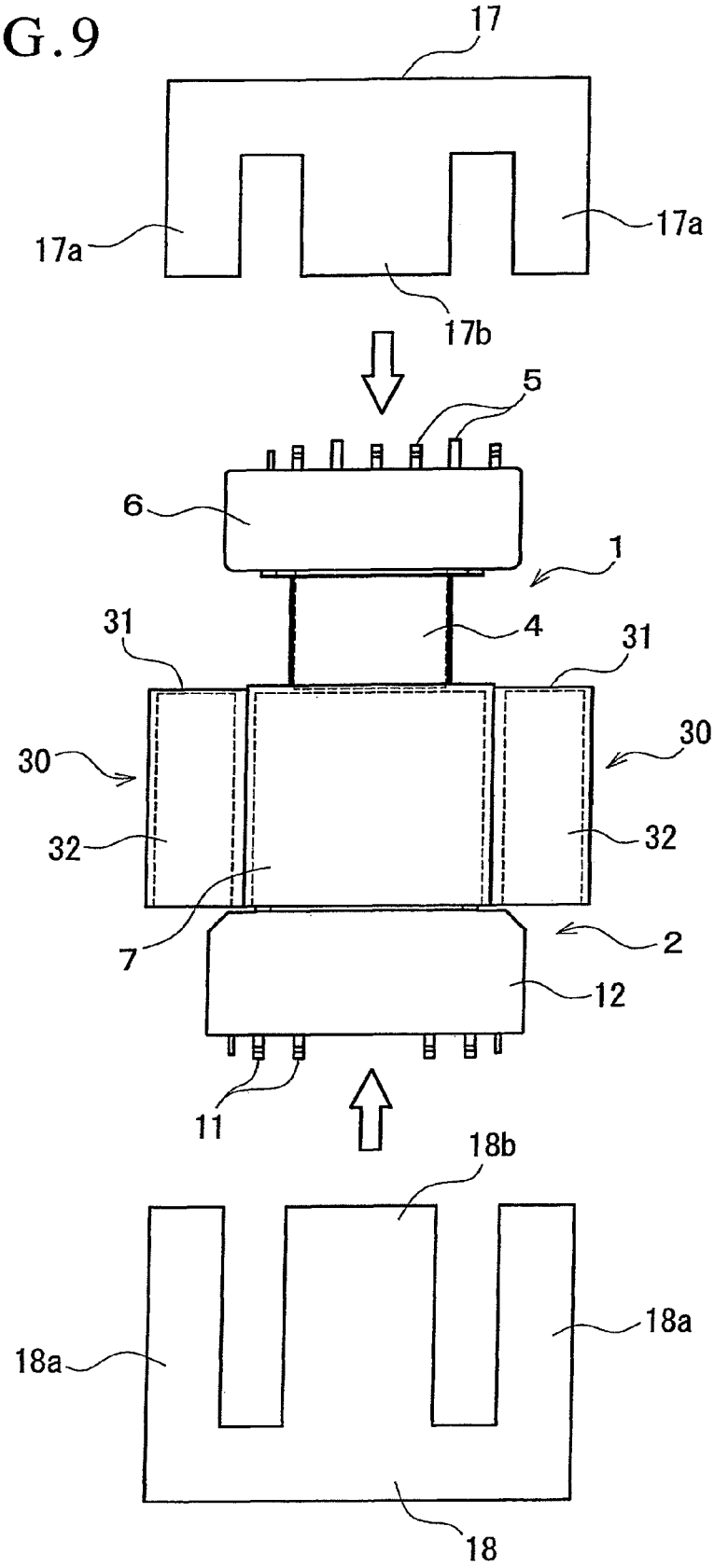
FIG. 9 is a plan view showing how first and second cores are assembled in the second embodiment.
Figure 10:
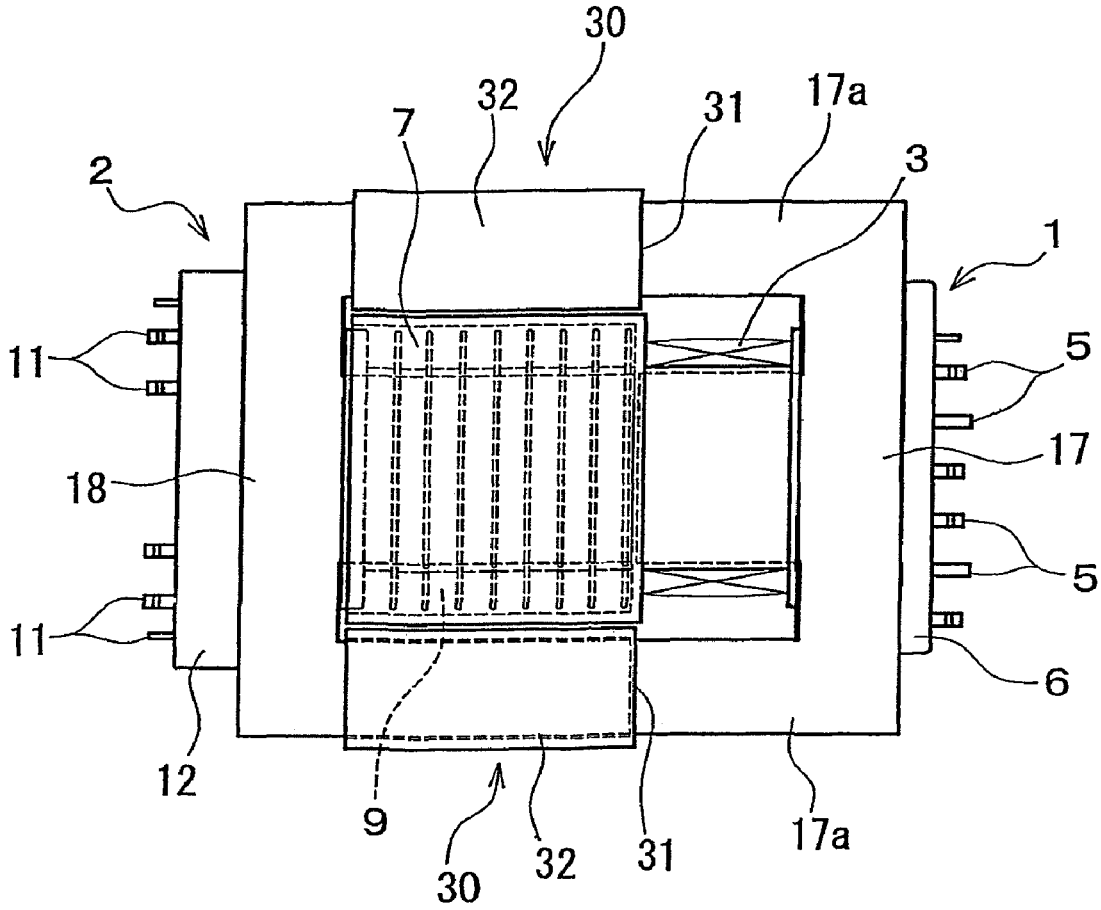
FIG. 10 is a plan view showing the overall transformer of the second embodiment.

FIGS. 8 to 10 show a second embodiment of the transformer according to the present invention. The components that are the same as those shown in FIGS. 1A to 6 have the same reference characters and the description thereof is simplified.

The transformer of the second embodiment differs from that of the first embodiment in that cover members (insulating members) 30 are molded integrally with the outer circumference of the insulating sheath 7 in the first bobbin 1.

That is, each of the cover members 30 formed on both sides of the axial direction of the insulating sheath 7 has the same transverse cross-sectional shape as that of each of the cover members 14 shown in the first embodiment and has an axial length equal to that of the insulating sheath 7. Each of the cover members 30 has a barrier 31 formed at the end facing the first winding portion 4 and hence has only one tubular section (outer circumference sheath) 32 that opens onto the second bobbin 2.

As shown in FIG. 9, the second core 18 is attached in such a way that the outer cores 18*a* are inserted into the tubular sections 32 of the respective cover members 30 and the inner core 18*b* is inserted into the internal space in the second winding portion 10. In contrast, the first core 17 is attached in such a way that the inner core 17*b* is inserted into the internal space in the first winding portion 4 and the front end surfaces of the outer cores 17*a* abut the outer surfaces of the barriers 31 of the respective cover members 30.

According to the thus configured transformer, an advantageous effect similar to that in the first embodiment can be provided. Further, since the cover members 30 are integrated with the outer circumference of the insulating sheath 7 in the transformer of the present embodiment, the cover members 30 can be formed by injection molding simultaneously with the first winding portion 4, the first terminal placement portion 6, and the insulating sheath 7. As a result, the transformer can be more readily manufactured, and the number of parts in the overall transformer can be reduced.

The first and second embodiments have been described only with reference to the case where the electrically insulating cover members 14, 20, 23, or 30 having a tubular section or tubular sections and a barrier is used as insulating members, but the invention is not limited thereto. Each of the insulating members can alternatively be obtained in a synthetic resin molding process by integrally forming outer circumference sheaths that cover the outer circumferences of at least one of the outer cores 17*a*, 18*a* and a barrier interposed between the opposing surfaces of the outer cores 17*a*, 18*a*.

Alternatively, an insulating member having the outer circumference sheath and the barrier described above can be formed by using other methods, for example, sheathing heat-shrinkable tubes or winding insulating tapes around at least one of the outer cores 17*a*, 18*a*.

Further, the first and second cores 17, 18 described above are not limited to the E-shaped cores including the outer cores 17*a*, 18*a* and the inner cores 17*b*, 18*b* described above. For example, each of the E-shaped cores may be replaced with a C-shaped core including only a pair of outer cores or the C-shaped core to which an I-shaped core is added in a central portion thereof so that the resultant core forms an E-shaped core. In any of these cases, a transformer having the same function can be formed.

Third Embodiment

FIGS. 11 to 17 show a third embodiment in which an isolation transformer according to the present invention is used as an inverter transformer for causing a cold-cathode tube that forms a backlight for an LCD to emit light. In the isolation transformer, a bobbin is divided into a first bobbin 101 and a second bobbin 102.

Figure 11:
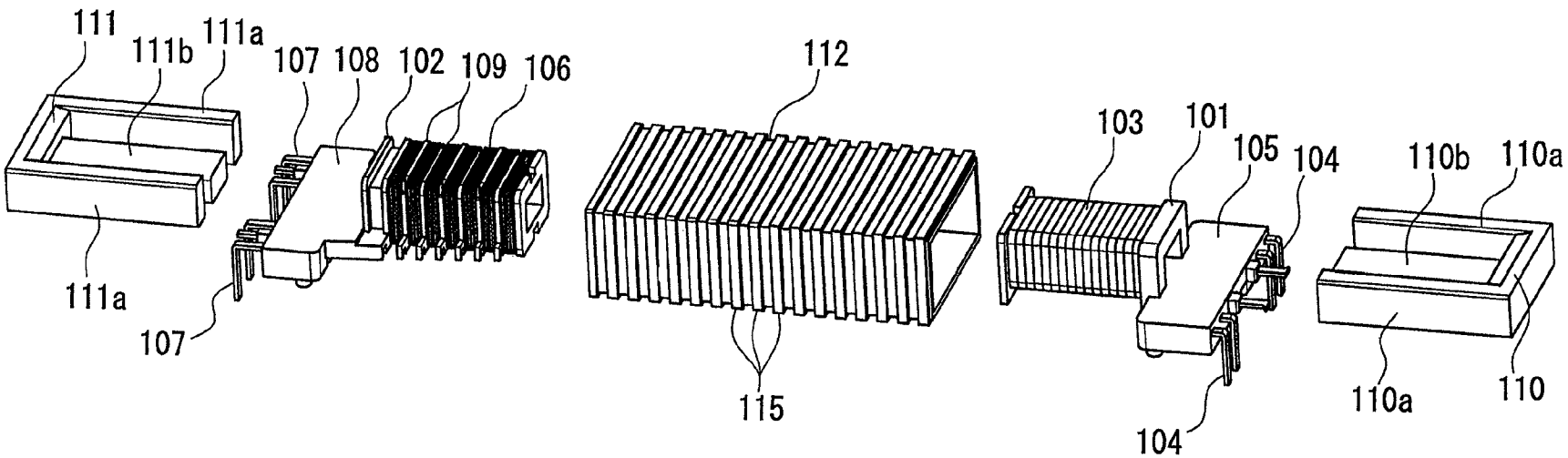
FIG. 11 is an exploded perspective view showing a third embodiment of an isolation transformer according to the present invention.
Figure 12:
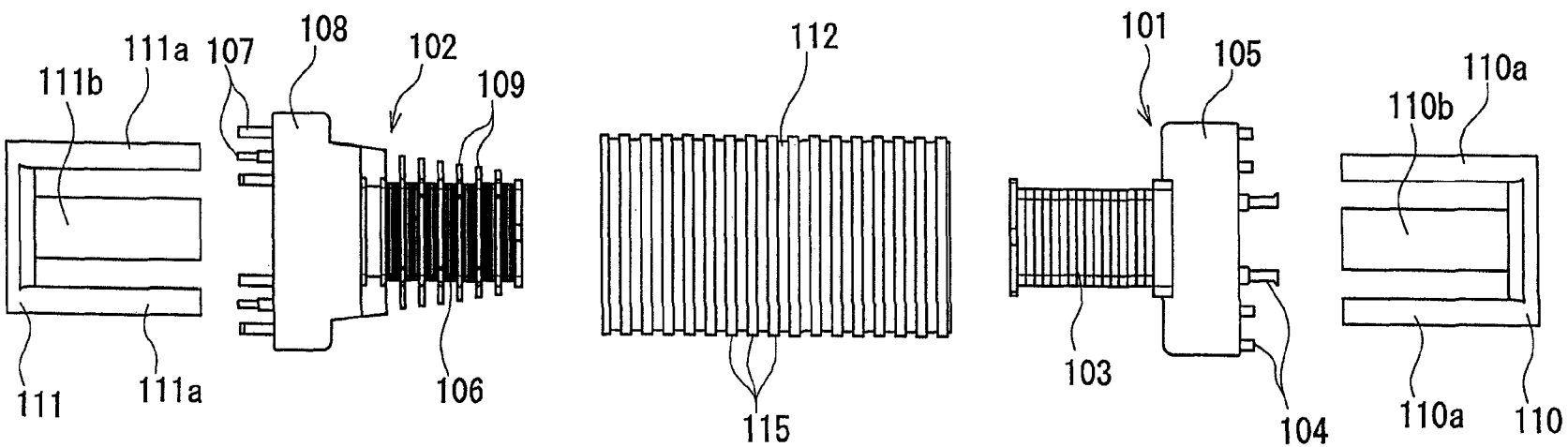
FIG. 12 is a plan view of the isolation transformer shown in FIG. 11.
Figure 13:
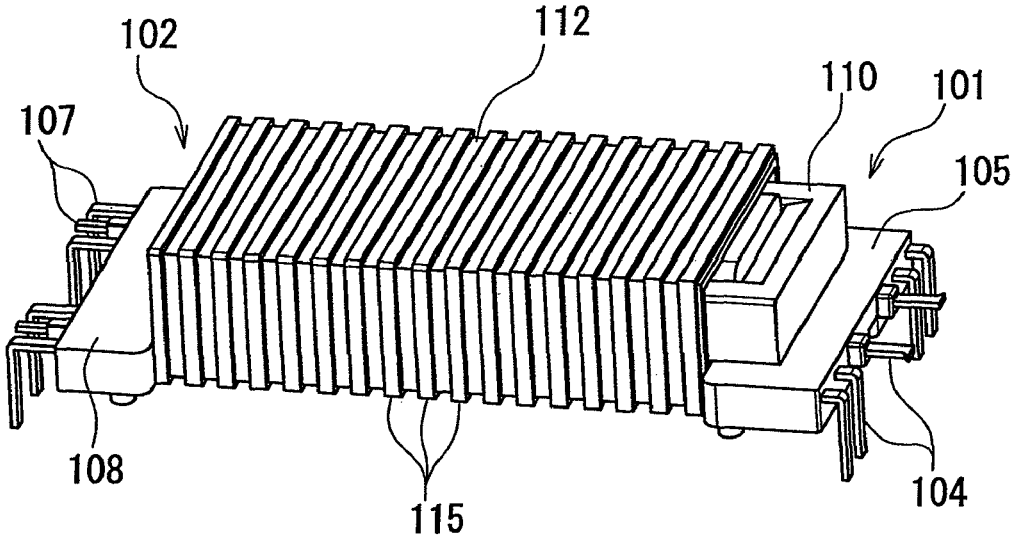
FIG. 13 is a perspective view showing the assembled isolation transformer shown in FIG. 11.
Figure 14:
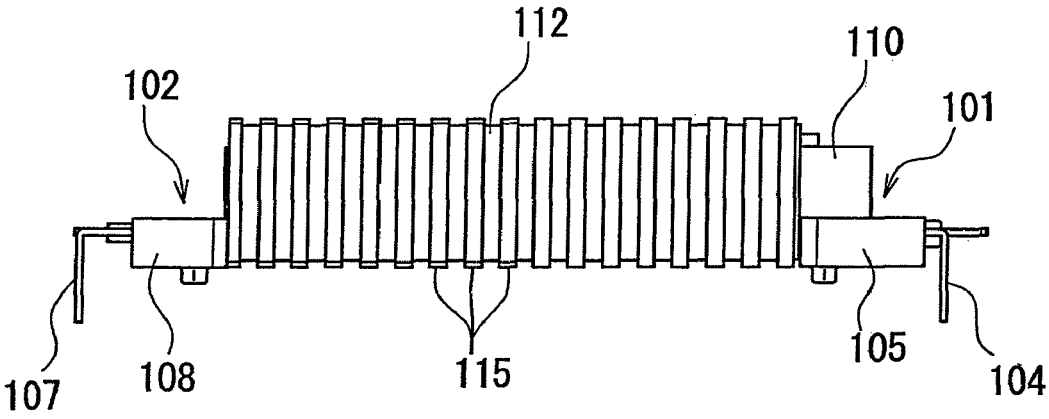
FIG. 14 is a front view of the isolation transformer shown in FIG. 13.
Figure 15:
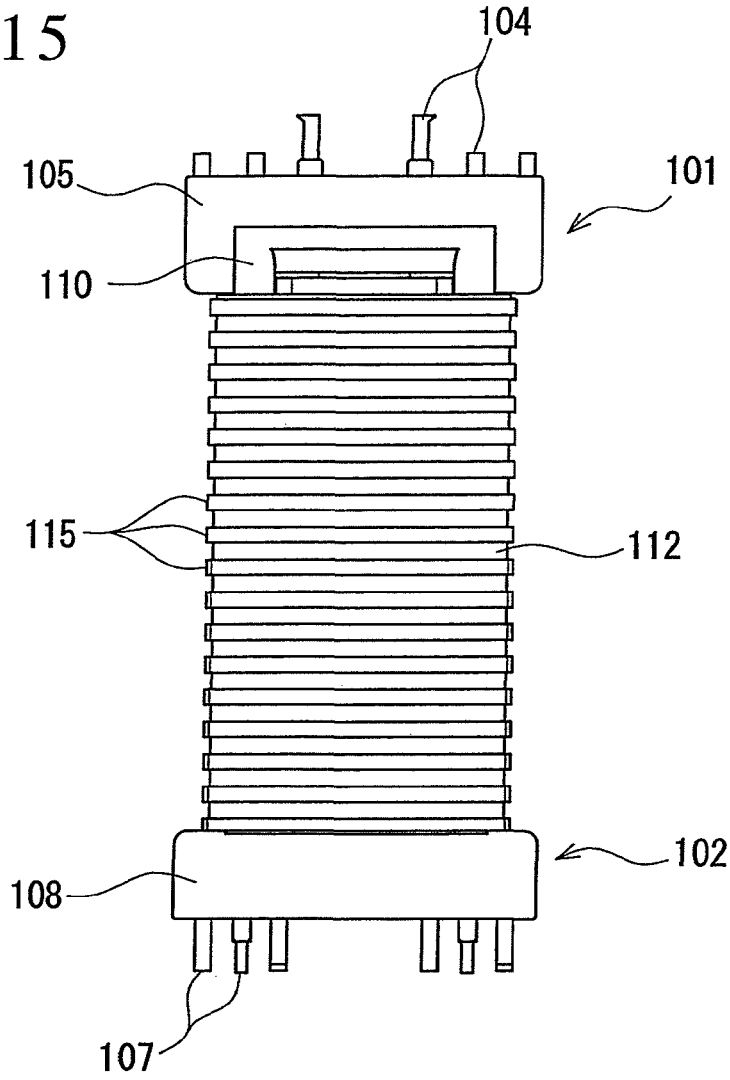
FIG. 15 is a plan view of the isolation transformer shown in FIG. 13.
Figure 16:
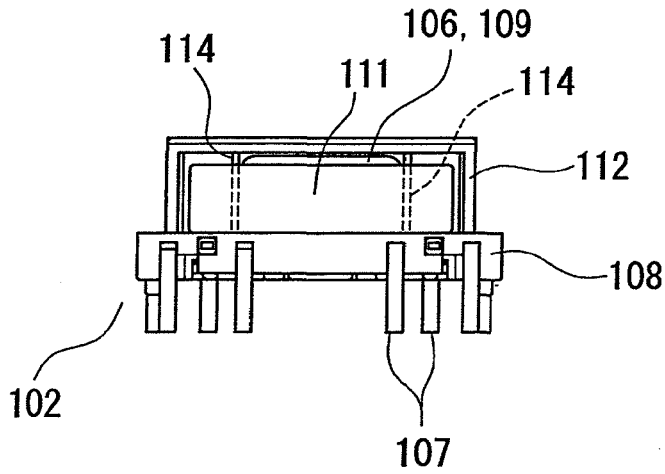
FIG. 16 is a left side view of the isolation transformer shown in FIG. 13.
Figure 17:
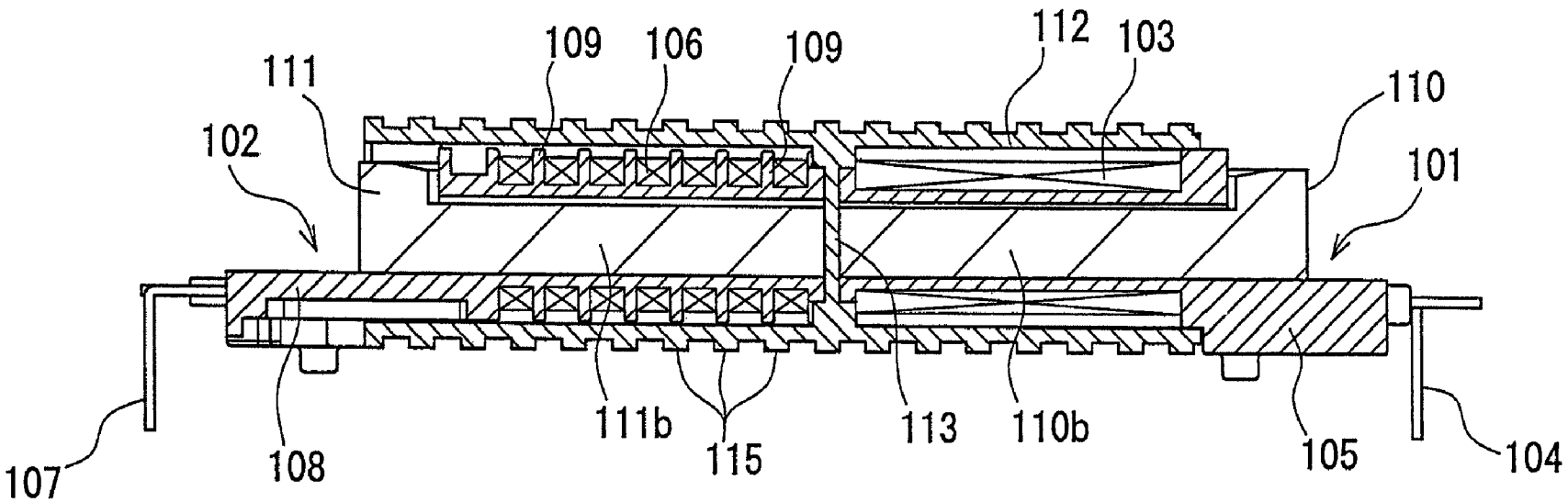
FIG. 17 is a longitudinal cross-sectional view of the isolation transformer shown in FIG. 13.

The first bobbin 101 includes a winding portion which is made of an electrically insulating synthetic resin and shaped into a rectangular tube and around the outer circumference of which a primary coil 103 is wound and a terminal placement portion 105 having a substantially rectangular plate-like shape which is disposed at one end of the winding portion in the axial direction and which is studded with terminals 104 to which to an end of the primary coil 103 is connected, the winding portion and the terminal placement portion 105 integrally molded, as shown in FIGS. 11, 12, and 17. The terminal placement portion 105 is formed in such a way that a surface thereof is seamlessly connected to an inner wall of the winding portion so that the winding portion has an open end.

Similarly, the second bobbin 102 includes a winding portion which is made of an electrically insulating synthetic resin and shaped into a rectangular tube and around the outer circumference of which a secondary coil 106 is wound and a terminal placement portion 108 having a substantially rectangular plate-like shape which is disposed at one end of the winding portion in the axial direction and which is studded with terminals 107 to which an end of the secondary coil 106 is connected, the winding portion and the terminal placement portion 108 integrally molded. The terminal placement portion 108 is also formed in such a way that a surface thereof is seamlessly connected to an inner wall of the winding portion so that the winding portion has an open end. The second bobbin 102 has a plurality of partitioning plates 109 formed at equal intervals in the axial direction around the outer circumference of the winding portion and integrated therewith to prevent creeping discharge from occurring in the high-voltage secondary coil 106.

Cores formed of first and second cores 110, 111 and forming a closed magnetic path are disposed in the first and second bobbins 101, 102. The first and second cores 110, 111 are E-shaped cores including pairs of outer cores 110*a*, 111*a* extending in the axial direction along the side surfaces of the respective primary and secondary coils 103, 106 in the first and second bobbins 101, 102 and inner cores 110*b*, 111*b* positioned in between the outer cores 110*a*, 111*a*.

Each of the outer cores 110*a* and the inner core 110*b* of the first core 110 has a length substantially equal to the axial length of the winding portion of the first bobbin 101, and each of the outer cores 111*a* and the inner core 111*b* of the second core 111 has a length substantially equal to the axial length of the winding portion of the second bobbin 102.

The first core 110 is attached to the first bobbin 101 in such a way that the inner core 110*b* is inserted into the internal space in the winding portion of the first bobbin 101 and the outer cores 110*a* are slightly spaced apart from both sides of the primary coil 103, forming primary-side parts including the first bobbin 101, around which the primary coil 103 is wound, and the first core 110.

On the other hand, the second core 111 is attached to the second bobbin 102 in such a way that the inner core 111*b* is inserted into the internal space in the winding portion of the second bobbin 102 and the outer cores 111*a* are slightly spaced apart from both sides of the secondary coil 106, forming secondary-side parts including the second bobbin 102, around which the secondary coil 106 is wound, and the second core 111.

The thus divided primary-side parts and secondary-side parts are inserted into an outer circumference sheath member 112.

The outer circumference sheath member 112 is a member made of an electrically insulating synthetic resin and molded into a rectangular tube, and the inner dimension of the outer circumference sheath member 112 is sized in such a way that the assembly of the first bobbin 101 and the outer cores 110*a* of the first core 110 and the assembly of the second bobbin 102 and the outer cores 111*a* of the second core 111 can be loosely inserted thereinto.

Further, the outer circumference sheath member 112 is formed to be long enough to surround at least the primary coil 103 and the secondary coil 106 seamlessly in the axial direction.

The outer circumference sheath member 112 has a barrier-shaped insulating wall (insulating member) 113 integrally molded therein, the insulating wall 113 closing an axially central portion of the outer circumference sheath member 112. The thickness of the insulating wall 113 in the axial direction is set at a value ranging from 1.0 to 0.4 mm.

The outer circumference sheath member 112 further has partitioning walls 114 integrally molded therein on both sides in the width direction, the partitioning wall 114 extending in the axial direction from the insulating wall 113 toward the end openings and interposed between the primary coil 103 and the respective outer cores 110*a* on both sides of the primary coil 103 and between the secondary coil 106 and the respective outer cores 111*a* on both sides of the secondary coil 106.

On the other hand, a plurality of annular protrusions 115 formed in the circumferential direction are integrally molded at equal intervals in the axial direction around the outer circumference of the outer circumference sheath member 112. As a result, a plurality of protrusions and recesses are formed along the axial direction around the outer circumference of the outer circumference sheath member 112.

The primary-side parts described above are accommodated in the outer circumference sheath member 112 with part of the first core 110 and the entire terminal placement portion 105 exposed to the outside when the entire primary coil 103 is inserted, from one side of the outer circumference sheath member 112, between the partitioning walls 114 in the outer circumference sheath member 112 and the outer cores 110*a* are inserted between the respective partitioning walls 114 and the inner wall of the outer circumference sheath member 112.

The secondary-side parts described above are accommodated in the outer circumference sheath member 112 with the entire second core 111 accommodated in the outer circumference sheath member 112 and only the terminal placement portion 108 exposed to the outside when the entire secondary coil 106 is inserted between the partitioning walls 114 from the opposite side of the outer circumference sheath member 112 relative to the one side from which the primary side parts are inserted, and the outer cores 111*a* are inserted between the respective partitioning walls 114 and the inner wall of the outer circumference sheath member 112.

As a result, the insulating wall 113 is interposed between the axially opposing surfaces of the first and second bobbins 101, 102 and between the opposing surfaces of the first and second cores 110, 111. Further, the outer circumference sheath member 112 surrounds the outer circumferences of the primary coil 103 and the secondary coil 106 as well as the outer cores 110*a* and the inner core 110*b* of the first core 110 and the entire second core 111 seamlessly in the axial direction.

In the thus configured isolation transformer, the cores disposed across the first and second bobbins 101, 102 to form a closed magnetic path are formed of the two divided E-shaped cores, the first core 110 positioned on the side where the first bobbin is present and the second core 111 positioned on the side where the second bobbin 102 is present, and the insulating wall 113 is interposed between the opposing surfaces of the primary-side parts and the secondary-side parts, the primary-side parts formed of the first bobbin 101 and the first core 110 and the secondary-side parts formed of the second bobbin 102 and the second core 111. Further, the tubular, insulating outer circumference sheath member 112 surrounds the outer circumferences of the primary coil 103 and the secondary coil 106 and the outer circumferences of the first core 110 and the second core 111 seamlessly in the axial direction.

Further, the plurality of protrusions 115 are formed around the outer circumference of the outer circumference sheath member 112 so that the outer circumference has protrusions and recesses in the axial direction. As a result, the axial length along the protrusions and recesses formed of the protrusions 115 (that is, the axial length of the outer circumference sheath member 112+the number of protrusions 115×the height of each of the protrusions×2) can be provided as the insulation distance between the primary-side parts and the secondary-side parts.

As a result, the insulation between the primary side and the secondary side can be improved in a simple structure without increase in overall size, whereby the total length and hence the size of the isolation transformer can be reduced, and an insulation distance required between the primary coil 103 and the secondary coil 106 can be relibly ensured particularly when a high voltage is inputted to the primary coil 103.

Further, since the barrier-shaped insulating wall 113 is integrally molded in the outer circumference sheath member 112, the number of parts is reduced and the structure is further simplified. An assembling operation can also be simplified because it can be completed by inserting the primary-side parts formed of the first bobbin 101 to which the first core 110 is attached from one opening of the outer circumference sheath member 112 and inserting the secondary-side parts formed of the second bobbin 102 to which the second core 111 is attached from the other opening of the outer circumference sheath member 112.

Further, since the partitioning walls 114 are formed in the outer circumference sheath member 112 between the primary coil 103 and the respective outer cores 110*a* of the first core 110 and between the secondary coil 106 and the respective outer cores 111*a* of the second core 111, the partitioning walls 114 can be used as a guide for inserting the outer cores 110*a* and 111*a* in the assembling operation.

Moreover, since the primary coil 103 and the secondary coil 106 can be independently accommodated in the tubular spaces formed by the partitioning walls 114 and the inner wall of the outer circumference sheath member 112, the primary coil 103 and the secondary coil 106 can be protected from the other members that otherwise interfere therewith. As a result, the overall structure and assembling operation can further be simplified because it is not necessary to wind separate protective tapes or other suitable components around the outer circumferences of the primary coil 103 and the secondary coil 106.

Figure 18:
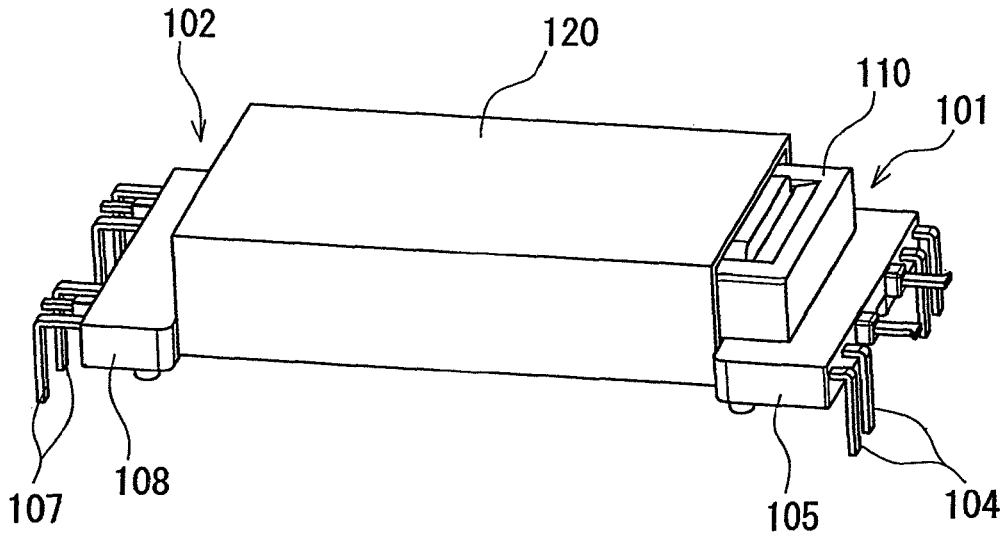
FIG. 18 is a perspective view showing another embodiment of the present invention.
Figure 19:
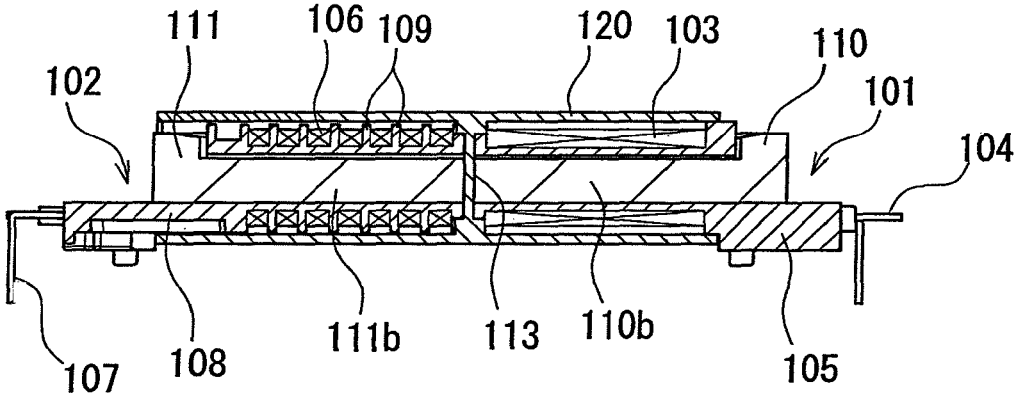
FIG. 19 is a longitudinal cross-sectional view of the isolation transformer shown in FIG. 18.

FIGS. 18 and 19 show another embodiment of the isolation transformer according to the present invention.

The isolation transformer of this embodiment has the same configuration as that shown in FIGS. 11 to 17 but differs therefrom in terms of the configuration of the outer circumference sheath member. That is, in the isolation transformer of this embodiment, the outer circumferential surface of an outer circumference sheath member 120 made of an electrically insulating synthetic resin and shaped into a rectangular tube is formed of flat surfaces.

In the thus configured isolation transformer as well, since the insulating wall 113 is interposed between the opposing surfaces of the primary-side parts and the secondary-side parts, and the outer circumferences of the primary coil 103 and the secondary coil 106 and the outer circumferences of the first core 110 and the second core 111 are seamlessly surrounded in the axial direction by the insulating outer circumference sheath member 120, the insulation distance corresponding to the axial length of the outer circumference sheath member 120 can be ensured between the primary-side parts and the secondary-side parts.

When a required insulation distance is shorter than or equal to that required in the isolation transformer shown in FIGS. 11 to 17, the outer circumference sheath member 120 can be preferably used by forming it with a material that is more excellent in electric insulation.

The above embodiments have been described only with reference to the case where the E-shaped cores formed of the outer cores 110*a*, 111*a* integrated with the inner cores 110*b*, 111*b* are used as the first and second cores 110, 111, the invention is not limited thereto. For example, each of the E-shaped cores may be replaced with a C-shaped core including only a pair of outer cores or the C-shaped core to which an I-shaped core is added in a central portion thereof so that the resultant core forms an E-shaped core.

INDUSTRIAL APPLICABILITY

As described above, any of the transformers according to the present invention allows the insulation between the primary side and the secondary side to be improved in a small, simple structure and a required insulation distance to be reliably ensured even when a higher voltage is applied.

The invention claimed is:

1. A transformer comprising:

a first bobbin including a first winding portion around which a primary coil is wound;

a second bobbin disposed adjacent to the first bobbin and including a second winding portion around which a secondary coil is wound; and a core made of a magnetic material, disposed across the first bobbin and the second bobbin, and forming a closed magnetic path, wherein the core is divided into a first core positioned on the side where the first bobbin is present and a second core positioned on the side where the second bobbin is present, and wherein the transformer further comprises an insulating member including (i) an outer circumference sheath and (ii) a first barrier interposed in a magnetically coupled portion between the first core and the second core, wherein the outer circumference sheath covers the outer circumference of at least one of the first core and the second core, wherein the first barrier is interposed between the opposing surfaces of the first core and the second core, wherein the first bobbin and the second bobbin are disposed adjacent to each other in the axial direction thereof, wherein each of the first core and the second core includes (i) a pair of outer cores extending in the axial direction along the outer sides of the corresponding one of the first bobbin and the second bobbin and (ii) an inner core positioned in between the outer cores and inserted into the corresponding one of the first winding portion and the second winding portion, wherein the insulating member is interposed between each of the first outer cores and the corresponding one of the second outer cores, wherein the transformer further comprises a second barrier formed between the first winding portion and the second winding portion, the second barrier being interposed between the opposing surfaces of the inner cores, wherein the transformer further comprises an insulating sheath formed at an end of one of the first winding portion and the second winding portion, the insulating sheath covering the outer circumference of the primary coil or the secondary coil that is not associated with the one of the first winding portion and the second winding portion, and wherein the insulating member is formed integrally with the outer circumference of the insulating sheath.

2. The transformer according to claim 1, wherein the transformer further comprises a pair of cover members formed on opposite ends of the insulating sheath, each of the pair of cover members including (i) a tubular section and (ii) a barrier, wherein the first inner core is inserted into an internal space in the first winding portion;

wherein the front end surfaces of the first outer cores abut the outer surfaces of the barriers of the pair of cover members, respectively, and wherein the second inner core is inserted into an internal space in the second winding portion, wherein the second outer cores are inserted into the tubular sections of the pair of cover members, respectively.

3. The transformer according to claim 1, wherein the insulating sheath is the same size as one of the primary coil and the secondary coil which the insulating sheet covers the outer circumference thereof.

4. An isolation transformer comprising:

a first bobbin around which a primary coil is wound;

a second bobbin which is disposed adjacent to the first bobbin in the axial direction thereof and around which a secondary coil is wound; and a core made of a magnetic material, disposed across the first bobbin and the second bobbin, and forming a closed magnetic path, wherein the core is divided in the axial direction into a first core positioned on the side where the first bobbin is present and a second core positioned on the side where the second bobbin is present, wherein the isolation transformer further comprises an insulating member interposed (i) between the axially opposing surfaces of the first bobbin and the second bobbin and (ii) between the opposing surfaces of the first core and second core, wherein the outer circumferences of the primary coil and the secondary coil and the outer circumferences of the first core and the second core are surrounded seamlessly in the axial direction by a tubular insulating outer circumference sheath member, wherein each of the first core and the second core is formed of an E-shaped core including (i) a pair of outer cores extending in the axial direction along the outer sides of the corresponding one of the first bobbin and the second bobbin and (ii) an inner core positioned in between the outer cores and inserted into the corresponding one of the first bobbin and the second bobbin, and wherein the tubular insulating outer circumference sheath member includes a partitioning wall interposed (i) between the primary coil and the secondary coil and (ii) between the first outer cores and the second outer cores, the partitioning wall being formed integrally with the tubular insulating outer circumference sheath member.

5. The isolation transformer according to claim 4, wherein the isolation transformer further comprises a plurality of annular protrusions formed in the circumferential direction at certain intervals in the axial direction around the outer circumference of the tubular insulating outer circumference sheath member.

* * * * *